US011435688B2

(12) United States Patent
Uegane et al.

(10) Patent No.: US 11,435,688 B2
(45) Date of Patent: Sep. 6, 2022

(54) IMAGE FORMING APPARATUS

(71) Applicant: FUJIFILM Business Innovation Corp., Tokyo (JP)

(72) Inventors: Takumi Uegane, Kanagawa (JP); Jun Noguchi, Kanagawa (JP); Eri Fukui, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 194 days.

(21) Appl. No.: 16/392,556

(22) Filed: Apr. 23, 2019

(65) Prior Publication Data

US 2020/0142343 A1 May 7, 2020

(30) Foreign Application Priority Data

Nov. 1, 2018 (JP) ..... JP2018-206339

(51) Int. Cl.
*G03G 15/00* (2006.01)

(52) U.S. Cl.
CPC ..... *G03G 15/6591* (2013.01); *G03G 15/6555* (2013.01)

(58) Field of Classification Search
CPC ..... G03G 2215/00468; G03G 15/6555
See application file for complete search history.

(56) References Cited

U.S. PATENT DOCUMENTS 5,995,773 A * 11/1999 Awano ..... G03G 15/6541 399/124
6,112,047 A * 8/2000 Kato ..... B65H 29/00 399/381
7,483,669 B2 * 1/2009 Satozaki ..... G03G 15/6552 399/405
7,515,871 B2 * 4/2009 Mae ..... G03G 15/6582 399/16
2003/0057641 A1 * 3/2003 Yamada ..... B42C 1/12 271/298
2007/0188794 A1 * 8/2007 Matsui ..... B65H 5/00 358/1.15

(Continued)

FOREIGN PATENT DOCUMENTS

JP 04350062 A * 12/1992 ..... G03G 15/655
JP 2003084515 A * 3/2003

(Continued)

*Primary Examiner* — Jennifer Bahls
(74) *Attorney, Agent, or Firm* — JCIPRNET

(57) ABSTRACT

An image forming apparatus includes an upper transport part and a lower transport part that are disposed vertically side by side in an apparatus body and transport a recording material, a relay section that is disposed at an upper part of the apparatus body and further transports the recording material transported from the lower transport part and that places the recording material transported from the upper transport part on an upper surface of the relay section, a post-processing section that is disposed on a side surface of the apparatus body, receives the recording material via the relay section, and performs post-processing, and a control unit that performs a control such that the recording material is transported from the upper transport part to the upper surface of the relay section in a case where the recording material is a long sheet.

11 Claims, 12 Drawing Sheets

(56) References Cited

U.S. PATENT DOCUMENTS

| | | | | |
|---|---|---|---|---|
| 2009/0232537 | A1* | 9/2009 | Ogasawara | G03G 15/5016 399/81 |
| 2012/0134728 | A1* | 5/2012 | Kotera | G03G 15/80 399/407 |
| 2017/0174464 | A1* | 6/2017 | Tanaka | B65H 31/20 |

FOREIGN PATENT DOCUMENTS

| | | |
|---|---|---|
| JP | 2004014363 | 1/2004 |
| JP | 2004145363 | 5/2004 |
| JP | 2006248635 | 9/2006 |

* cited by examiner

ENLARGE PORTION A

IMAGE FORMING APPARATUS

CROSS-REFERENCE TO RELATED APPLICATIONS

This application is based on and claims priority under 35 USC 119 from Japanese Patent Application No. 2018-206339 filed Nov. 1, 2018.

BACKGROUND

(i) Technical Field

The present invention relates to an image forming apparatus.

(ii) Related Art

In an image forming system including an image forming apparatus body, a post-processing device, and a control device that controls operation of the image forming apparatus body and the post-processing device, there is known the image forming system in which the post-processing device can be moved between a first setting position for receiving a long paper to be ejected by the image forming apparatus body, and a second setting position for receiving a non-long paper (JP2006-248635A).

In an image forming apparatus which has a scanner that reads an original document, an image forming unit that forms a target image on a sheet material, and a sheet ejection unit provided between the scanner and the image forming unit and in which the sheet material on which the target image is formed by the image forming unit is stacked via the sheet ejection unit, there is also known the image forming apparatus including a sheet material transport unit that is provided between the scanner and the image forming unit, is connected to the sheet ejection unit, and includes a transport path along which the sheet material is transported from the sheet ejection unit to one side surface of the apparatus body (JP2004-145363A).

SUMMARY

Aspects of non-limiting embodiments of the present disclosure relate to an image forming apparatus that supports a long region in a transport direction as compared to a case where a long sheet to be transported is placed only on a placing part on which a recording material of a normal size is placed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an upper transport part and a lower transport part that are disposed vertically side by side in an apparatus body and transport a recording material; a relay section that is disposed at an upper part of the apparatus body and further transports the recording material transported from the lower transport part and that places the recording material transported from the upper transport part on an upper surface of the relay section; a post-processing section that is disposed on a side surface of the apparatus body, receives the recording material via the relay section, and performs post-processing; and a control unit that performs a control such that the recording material is transported from the upper transport part to the upper surface of the relay section in a case where the recording material is a long sheet.

BRIEF DESCRIPTION OF THE DRAWINGS

Exemplary embodiment(s) of the present invention will be described in detail based on the following figures, wherein.

DETAILED DESCRIPTION

Figure 1:
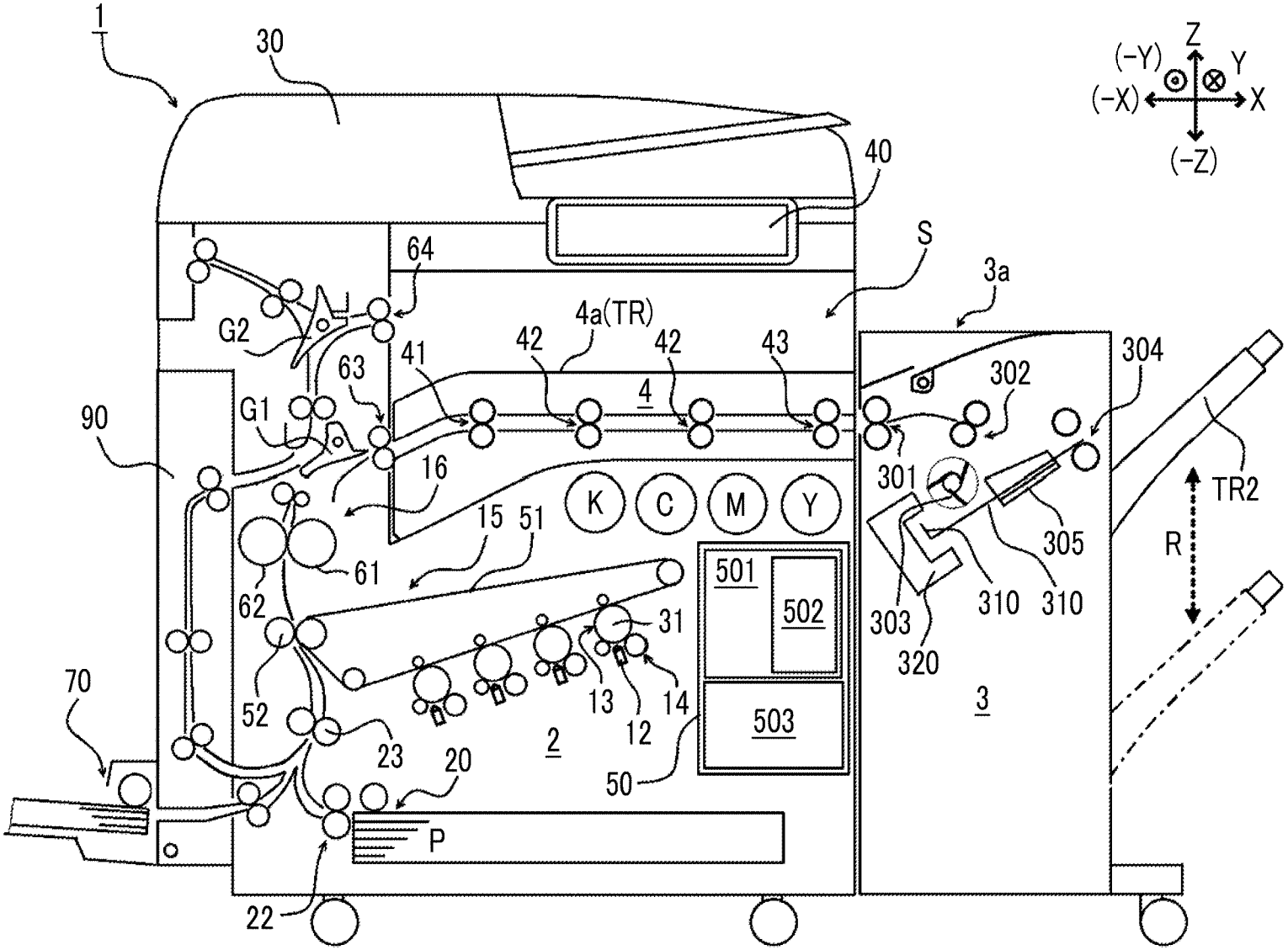
FIG. 1 is a schematic configuration view illustrating an image forming apparatus according to the present exemplary embodiment.

Next, although exemplary embodiments and specific examples will be given below and the present invention will be described in more detail referring to the drawings, the present invention is not limited to the exemplary embodiments and the specific examples.

Additionally, in the following description using the drawings, it should be noted that the drawings are schematic and scales of respective dimensions, or the like are different from actual one, and illustration of those other than members required for description will be appropriately omitted for easy understanding.

In addition, in order to facilitate understanding of the following description, in the drawings, a forward-backward direction is defined as an X-axis direction, a leftward-rightward direction is defined as a Y-axis direction, and an upward-downward direction is defined as a Z-axis direction.

1 Overall Configuration and Operation of Image Forming Apparatus

Figure 2:
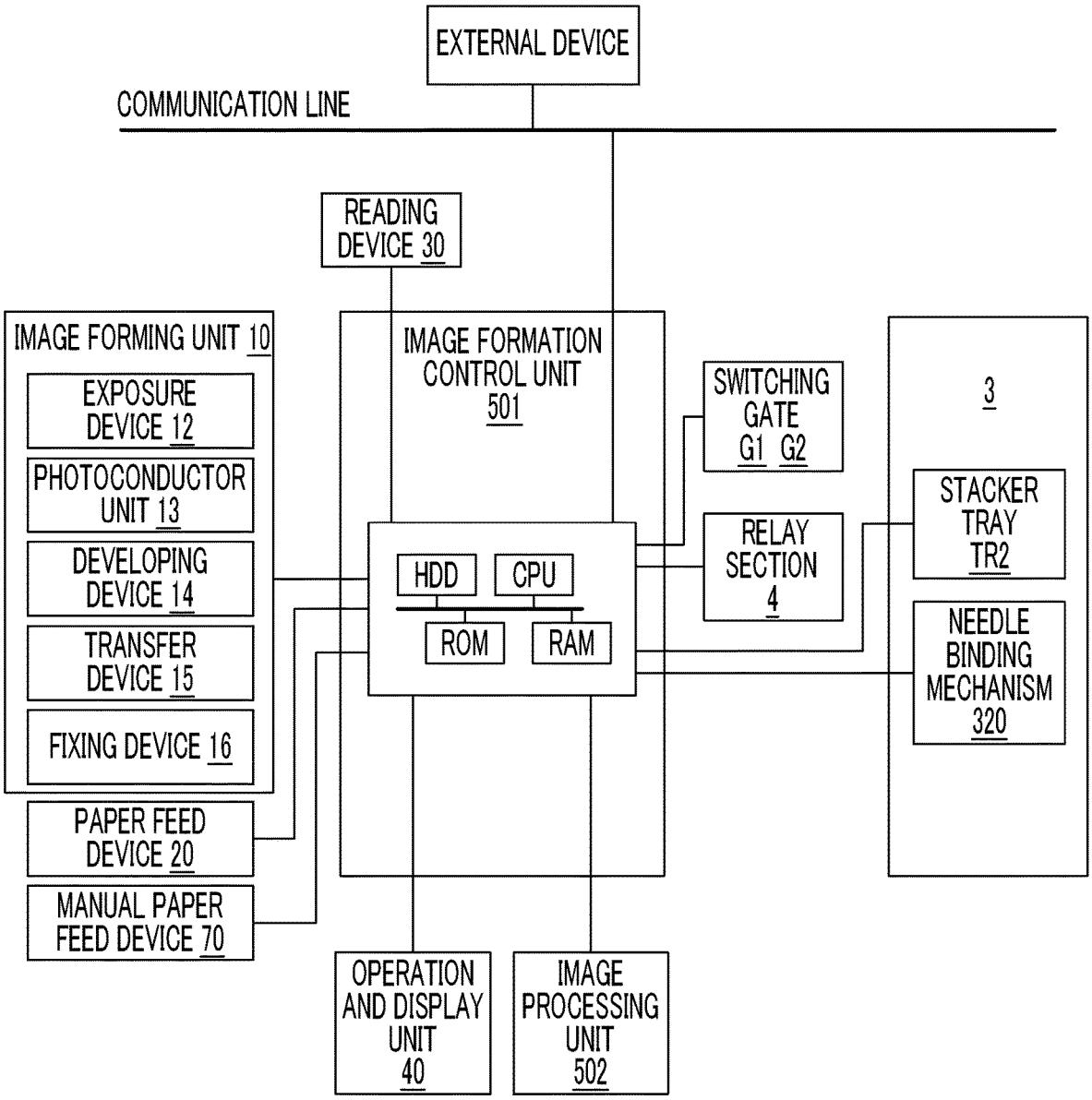
FIG. 2 is a block diagram illustrating a functional configuration of the image forming apparatus.

FIG. 1 is a schematic configuration view illustrating an image forming apparatus 1 according to the present exemplary embodiment, and FIG. 2 is a block diagram illustrating a functional configuration of the image forming apparatus 1.

The image forming apparatus 1 illustrated in FIG. 1 includes an image forming body section 2 that forms an image on paper P as a recording material; a post-processing section 3 that performs post-processing on the paper P on which the image is formed by the image forming body section 2; and a relay section 4 that transports the paper P disposed on a upper surface of the image forming body section 2 and ejected from the image forming body section 2 to the post-processing section 3.

Hereinafter, the overall configuration and operation of the image forming apparatus 1 will be described, referring to the drawings.

1.1 Overall Configuration and Operation of Image Forming Body Section 2

The image forming body section 2 is configured to include an image forming unit 10; a paper feed device 20 mounted on a bottom part of the image forming unit 10; a reading device 30 mounted on an upper part of the image forming unit 10; an operation and display unit 40; a control device 50, and a manual paper feed device 70 mounted on a left side of the image forming unit 10.

The image forming unit 10 is configured to include an exposure device 12, a photoconductor unit 13, a developing device 14, a transfer device 15, and a fixing device 16, and forms image information as a toner image on the paper P serving as a recording material fed thereinto from the paper feed device 20 or the manual paper feed device 70.

The reading device 30 serving as a reading unit is disposed above the image forming unit 10. The reading device reads an image of a sheet with an image sensor (not illustrated), such as a charge coupled device (CCD) line sensor, and convert the read image into image data that is electrical signals.

The operation and display unit 40 that is a user interface is disposed on a front surface side of the reading device 30. The operation and display unit 40 is configured by combining a liquid-crystal-display panel, various operation buttons, a touch panel, and the like, and a user of the image forming apparatus 1 inputs various settings and instructions via the operation and display unit 40. Additionally, various kinds of information are displayed to the user of the image forming apparatus 1 via the liquid-crystal-display panel.

The control device 50 has an image formation control unit 501 that controls the operation of the image forming apparatus 1, an image processing unit 502 that prepares image data according to a printing processing request, a power supply device 53, and the like. The image processing unit 502 converts printing information input from an external information transmitting device (for example, a personal computer or the like) into image information for forming a latent image, and outputs a driving signal to the exposure device 12 at a preset timing. The exposure device 12 of the present exemplary embodiment is constituted of an LED head in which light emitting diodes (LEDs) are linearly disposed.

The power supply device 53 applies a predetermined bias voltage for forming an image on the photoconductor unit 13, the developing device 14, and the transfer device 15, and the like and supplies electrical power to the exposure device 12, the fixing device 16, and the like.

The paper feed device 20 is provided at the bottom part of the image forming unit 10. The paper feed device 20 includes a paper stacking plate 21, and the paper P serving as a number of recording materials is stacked on an upper surface of the paper stacking plate 21. The paper P, which is stacked on the paper stacking plate 21 and positioned in a width direction by a regulating plate (not illustrated), is pulled sheet by sheet forward (−X direction) from above by a paper pull-out part 22 and then transported to a nip part of a register roller pair 23.

The manual paper feed device 70 is provided on a side of the image forming unit 10. The manual paper feed device 70 is foldable with respect to an opening and closing member and delivers a recording medium, such as paper with non-standard size, a specific cardboard, a postcard, a long sheet that is longer than a normal size, and a plastic film, which is not easily fed to the nip part of a transport roll pair 24 by the paper feed device 20.

The paper P delivered from the paper feed device 20 or the manual paper feed device 70 is transported to the register roller pair 23, and is transported to a secondary transfer nip part in a state where a leading edge thereof is aligned by the register roller pair 23.

Photoconductor units 13 are provided in parallel above the paper feed device 20, and each includes a photoconductor drum 31 that is rotationally driven. On the respective photoconductor drums 31 on which electrostatic latent images are formed by exposure devices 12, toner images of yellow (Y), magenta (M), cyan (C), and black (K) are formed by developing devices 14, respectively.

The respective color toner images, which are respectively formed on the photoconductor drums 31 of the photoconductor units 13, are sequentially and electrostatically transferred (primary transfer) onto an intermediate transfer belt 51 of the transfer device 15, and a superimposed toner image on which respective color toners are superimposed is formed. The superimposed toner image on the intermediate transfer belt 51 is delivered from the register roller pair 23 and collectively transferred to the paper P guided by a transportation guide by a secondary transfer roller 52.

In the fixing device 16, a fixing nip part NP (fixing region) is formed by a pressure contact region between a pair of heating modules 61 and a pressurizing module 62.

The paper P onto which the toner images are collectively transferred in the transfer device 15 is transported to the fixing nip part NP of the fixing device 16 in a state where the toner images are not fixed, and the toner images are fixed with the actions of heating and pressing by the pair of heating modules 61 and the pressurizing module 62.

The paper P on which the fixed toner images are formed is guided by switching gates G1 and G2 and is ejected from a first ejection roller pair 63 serving an example of a lower transport part among the ejection roller pairs disposed vertically side by side to the relay section 4 disposed within a body S of the image forming body section 2. Additionally, the paper P is ejected from a second ejection roller pair 64 serving as an example of an upper transport part to an upper surface 4*a* of the relay section 4 by switching the position of the switching gate G1.

1.2 Configuration and Operation of Post-Processing Section 3 and Relay Section 4

The post-processing section 3 receives the paper P output from the image forming body section 2 via the relay section 4, and includes, for example, a compile tray 310 that collects and bundles the paper P, and a needle binding mechanism (binding part) 320 that binds an end part of the paper P.

The relay section 4 has an inlet roller 41 that receives the paper P output via the first ejection roller pair 63 of the image forming body section 2, first transporting rollers 42 and 42 that transport the paper P received by the inlet roller 41 to a downstream side, and a second transporting roller 43 that transports the paper P toward the post-processing section 3.

The upper surface 4*a* of the relay section 4 becomes a paper ejection tray TR on which the paper P output via the second ejection roller pair 64 of the image forming body section 2 is placed. The paper ejection tray TR functions as a guide that guides the long sheet LS ejected from the second ejection roller pair 64 toward an upper surface 3*a* of the post-processing section 3 in a case where the paper P to be output is the long sheet LS that is longer than the normal size.

The post-processing section 3 includes the compile tray 310 that is provided on a downstream side of a reception roller 301, which receives the paper P from the relay section 4, and that collects and accommodates a plurality of sheets of the paper P, and ejection rollers 302 that are a pair of rollers that eject the paper P toward the compile tray 310.

Additionally, the post-processing section 3 includes a paddle 303 that rotates so as to push the paper P into an end guide 310*b* of the compile tray 310, and a tamper 305 for aligning an end part of the paper P.

Moreover, the post-processing section 3 has a needle binding mechanism 320 that binds an end part of a paper bundle PB stacked on the compile tray 310, and the bound paper bundle PB is transported and ejected by an ejection roller (paper bundle transporting roller) 304.

Also, a stacker tray TR2 serving as an example of a stacking unit that moved up and down and stacks the paper bundle PB ejected by the ejection roller 304 so that a user easily take the paper bundle PB are provided on a side surface side of the post-processing section 3.

2 Transport of Long Sheet

Figure 3:
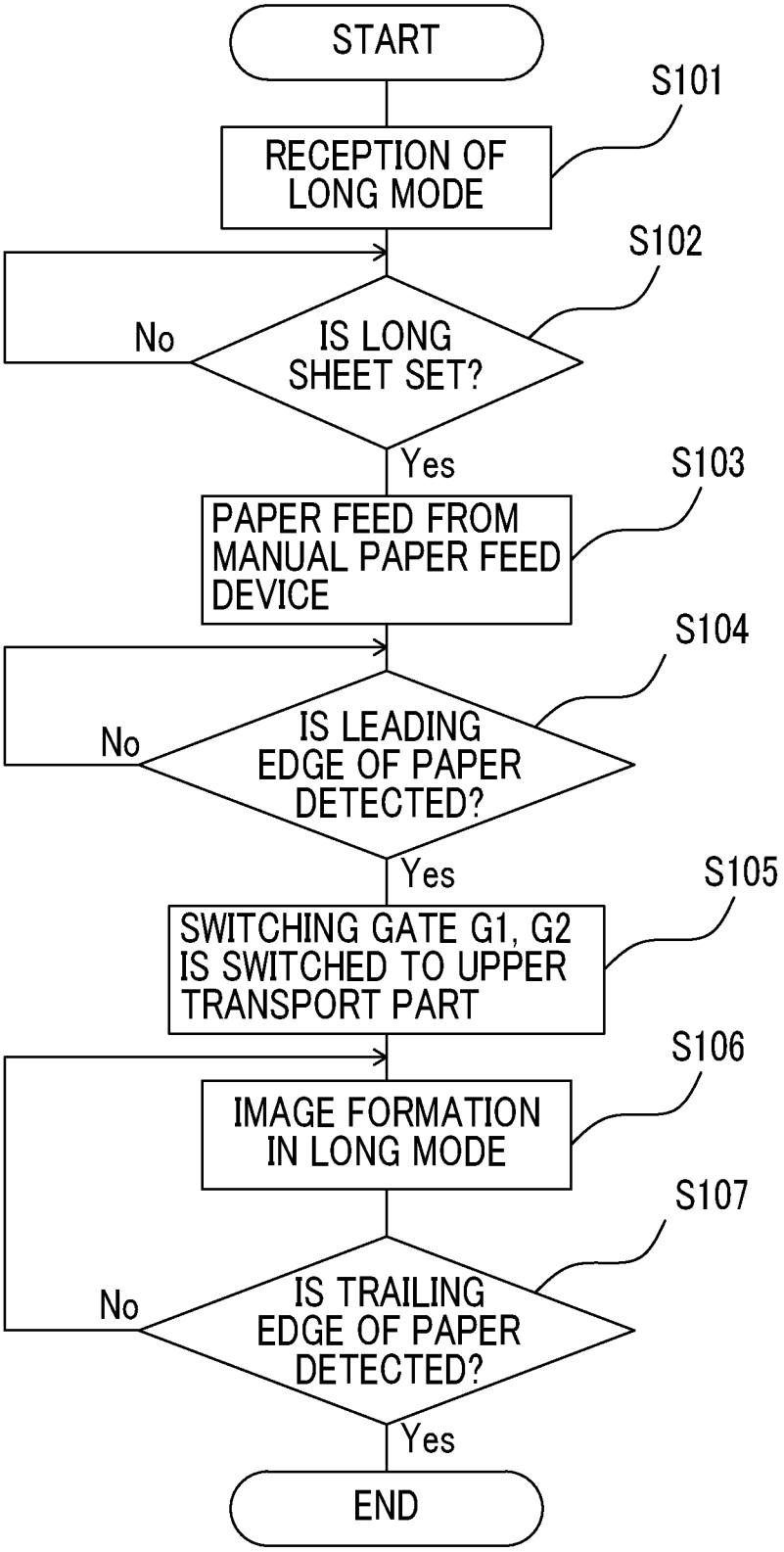
FIG. 3 is a flowchart illustrating a flow of operation of long sheet printing.
Figure 4:
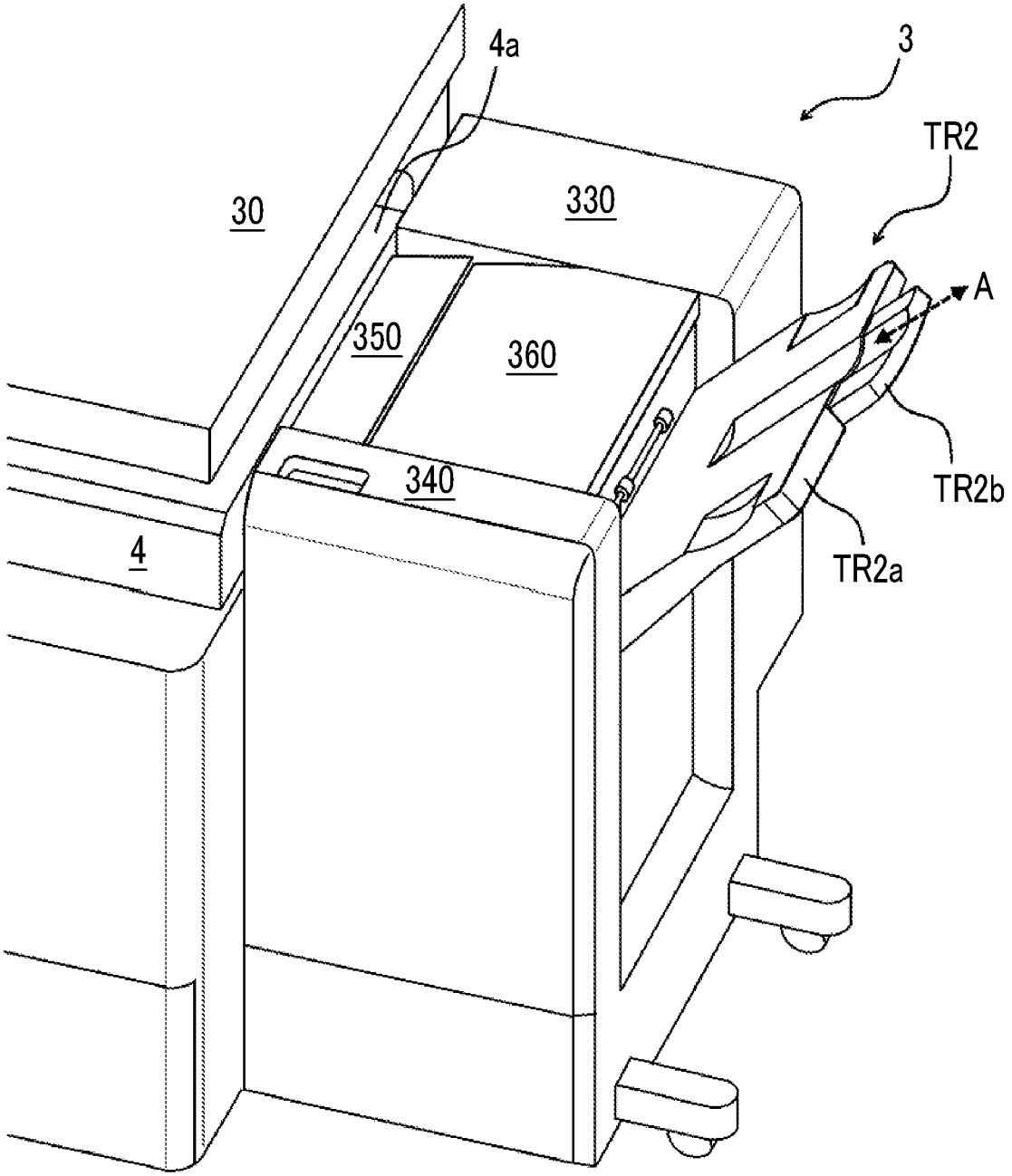
FIG. 4 is a perspective view with a view point on an upper surface side of a post-processing section.
Figure 5A:
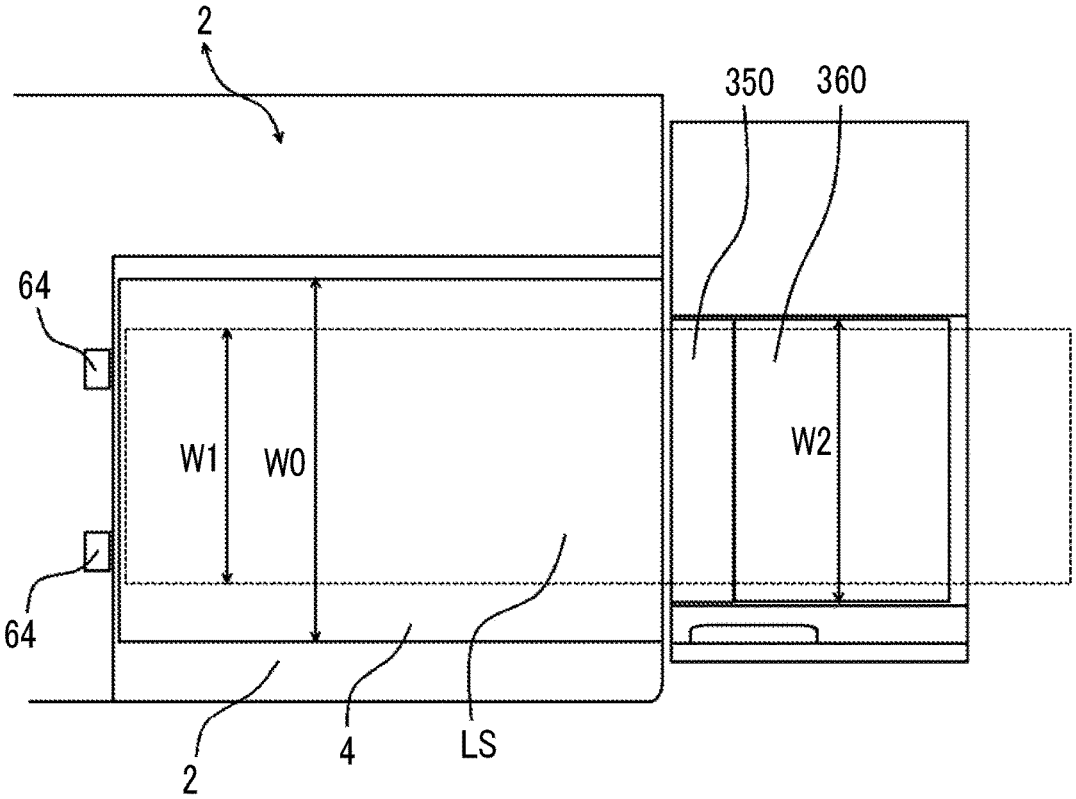
FIG. 5A is a plan schematic view illustrating a relationship in a width direction between a relay section and the post-processing section.
Figure 5B:
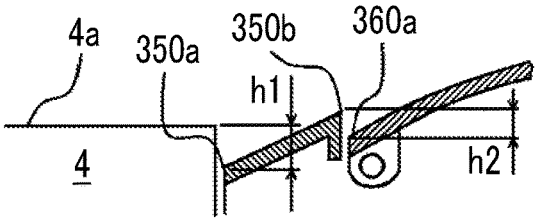
FIG. 5B is a cross-sectional schematic view illustrating a relationship in a height direction between the relay section and the post-processing section.
Figure 5B:
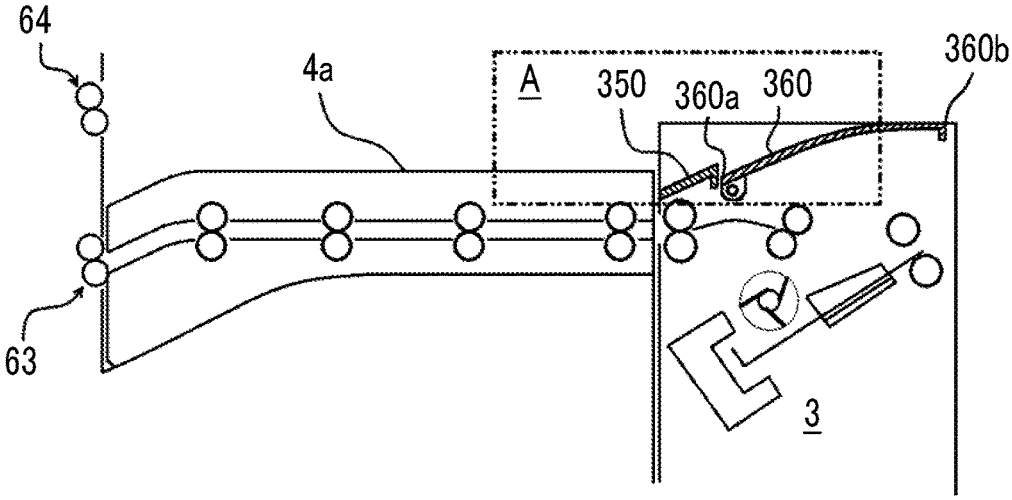
Figure 6:
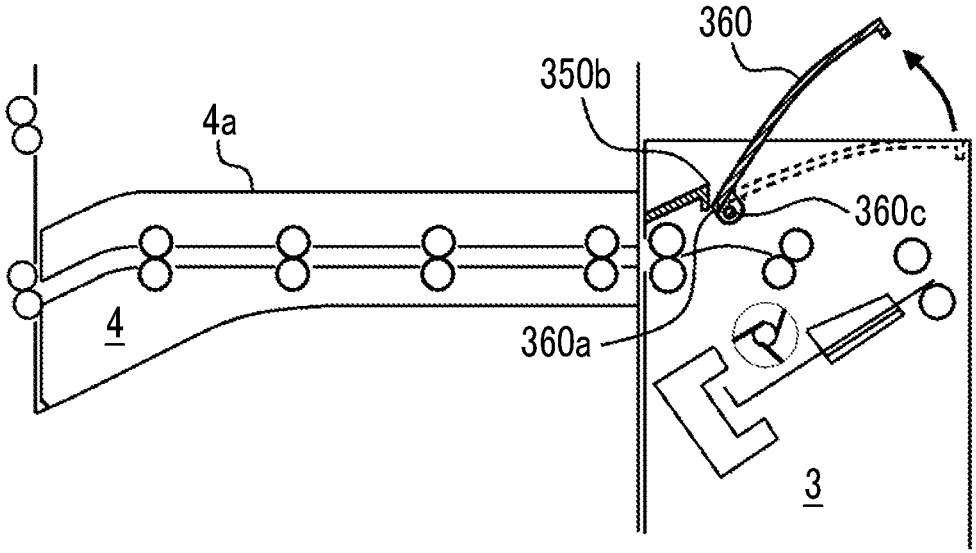
FIG. 6 is a cross-sectional schematic view illustrating opening and closing of an upper surface of the post-processing section.
Figure 12:
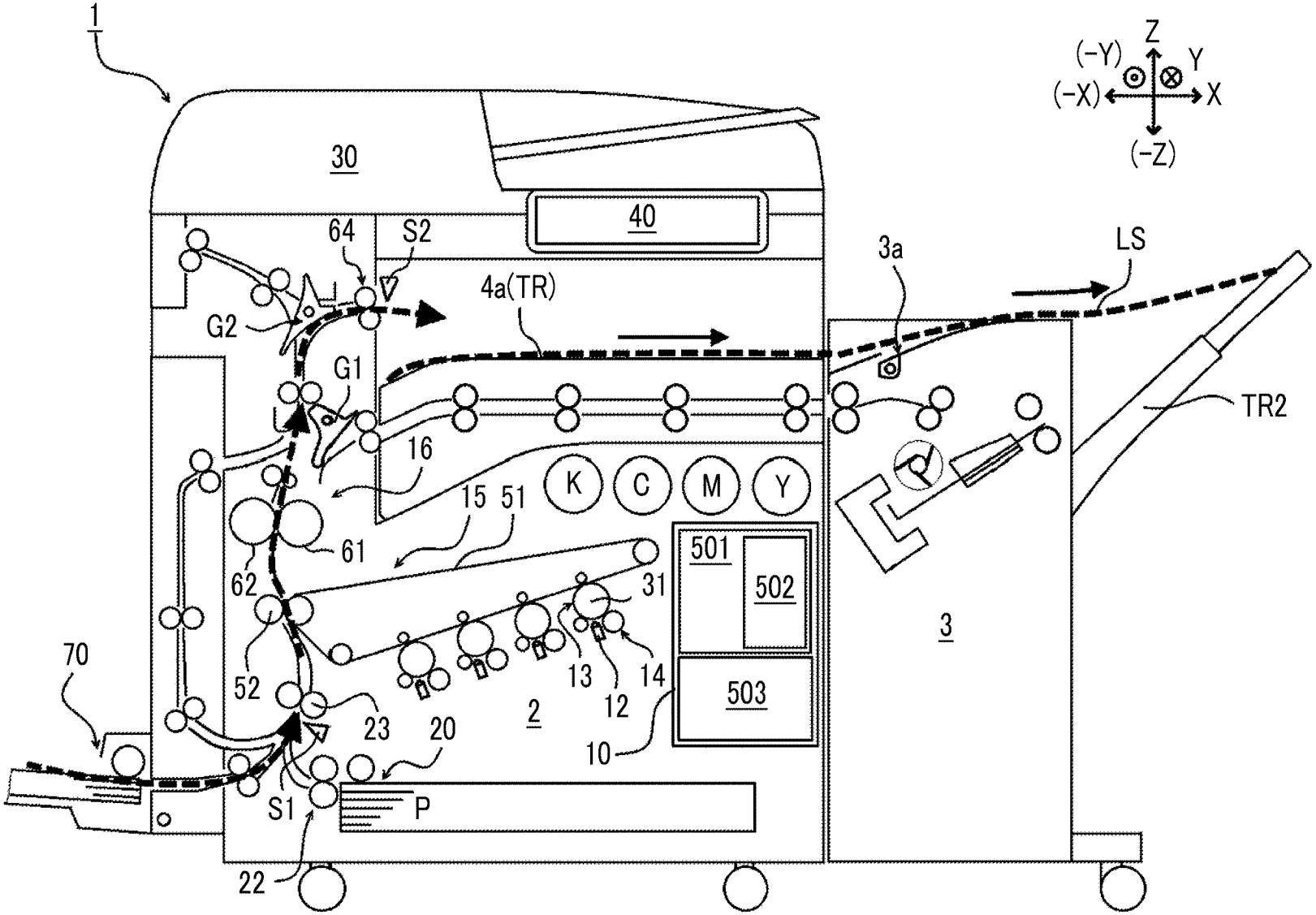
FIG. 12 is a cross-sectional schematic view of an image forming apparatus illustrating a transport route for a long sheet.

FIG. 12 is a cross-sectional schematic view of the image forming apparatus 1 illustrating a transport route for a long sheet LS, FIG. 3 is a flowchart illustrating a flow of operation of long sheet printing, FIG. 4 is a perspective view with a view point on an upper surface side of the post-processing section 3, FIG. 5A is a plan schematic view illustrating a relationship in the width direction between the relay section and the post-processing section 3, FIG. 5B is a cross-sectional schematic view illustrating a relationship in the height direction between the relay section 4 and the post-processing section 3, and FIG. 6 is a cross-sectional schematic view illustrating opening and closing of an upper surface of the post-processing section 3.

Hereinafter, transport of the long sheet LS in the image forming apparatus 1 will be described, referring to the drawings.

2.1 Transport of Long Sheet

As illustrated as the transport route in FIG. 12, the long sheet LS fed from the manual paper feed device 70 has a leading edge aligned the register roller pair 23 and has an image formed thereon by the image forming unit 10. Then, the long sheet LS fixed by the fixing device 16 is guided by the switching gate G1 switched to the second ejection roller pair 64 side, is transported upward, and is transported from the second ejection roller pair 64 onto the upper surface 4*a* of the relay section 4. Then, the long sheet LS is transported on the upper surface 4*a* of the relay section 4 and is transported to the upper surface 3*a* of the post-processing section 3.

In a case where an image is formed on the long sheet LS serving as an example of the recording material in which the length of the paper P in a transport direction is longer than A3 size (420 mm), a long mode is selected via the operation and display unit 40 (S101). In the long mode, processing, such as delay jamming, which is different from that in the normal size is performed on the assumption that paper size is long in the transport route.

In a case where the long mode is selected (S101; Yes), it is determined whether or not the long sheet LS is set in the manual paper feed device 70 (S102). In a case where the long sheet LS is set in the manual paper feed device 70 (S102; Yes), paper feed is started from the manual paper feed device 70 (S103).

Then, in a case where the leading edge of the long sheet LS is detected in front of the register roller pair 23 (S104; Yes), the switching gates G1 and G2 are switched to bring the transport route to the second ejection roller pair 64 side that is the upper transport part (S105). Accordingly, the long sheet LS after fixation is transported onto the paper ejection tray TR that is an upper surface of the relay section 4. Then, image formation is performed on the long sheet LS (S106), and the long sheet LS is transported until a trailing edge of the paper is detected by the second ejection roller pair 64 (S107; Yes). In this way, the long sheet LS fed from the manual paper feed device 70 is transported from the second ejection roller pair 64 to the upper surface 4*a* (paper ejection tray TR) of the relay section 4.

2.2 Transport Route

As illustrated in FIG. 4, the upper surface 3*a* of the post-processing section 3 is constituted of a far-side upper surface 330 that has the height of the entire post-processing section 3 on the far side (Y direction) of the post-processing section 3 and covers the interior of the post-processing section 3; a near-side upper surface 340 that has the identical height to the far-side upper surface 330 on the near side (−Y direction) of the post-processing section 3; a first upper surface 350 that has a lower height than the far-side upper surface 330 and the near-side upper surface 340; and a second upper surface 360 continuous with the first upper surface 350. Additionally, as illustrated in FIG. 4, following the second upper surface 360, the stacker tray TR2 having an extended tray TR2*b* moves uppermost (Z direction) most and is located on a side surface side of the post-processing section 3.

Then, as illustrated in FIG. 5A, a transport region W1 for the long sheet LS in the upper surface 4*a* of the relay section 4 is narrower than a width W0 of the upper surface 4*a* of the relay section 4. Then, the first upper surface 350 and the second upper surface 360 in the upper surface 3*a* of the post-processing section 3 have such a width W2 that the long sheet LS can be placed in correspondence with the transport region W1 for the long sheet LS disposed on a downstream side of the relay section 4.

As illustrated in FIG. 5B, a base end part 350*a* that is located on an upstream side (−X direction) of the first upper surface 350 in the transport direction of the long sheet LS is lower than the upper surface 4*a* of the relay section 4 (refer to h1 illustrated in the enlarged view of FIG. 5B). Also, a terminal part 350*b* of the first upper surface 350 in the transport direction downstream side (X direction) becomes higher than the base end part 350*a*.

Additionally, as illustrated in FIG. 5B, a base end part 360*a* that is located on an upstream side in the transport direction of the long sheet LS of the second upper surface 360 is lower than the terminal part 350*b* of the first upper surface 350 (refer to h2 illustrated in the enlarged view of FIG. 5B). Also, the second upper surface 360 becomes gently higher toward a terminal part 360*b* on the downstream side in the transport direction with respect to the base end part 360*a*.

In this way, in the transport region for the long sheet LS in the upper surface 3*a* of the post-processing section 3, the base end part 350*a* continuous with the upper surface 4*a* of the relay section 4 is lower than the upper surface 4*a* of the relay section 4 and becomes gently higher toward the terminal part 360*b* of the second upper surface 360 on the downstream side in the transport direction of the long sheet LS.

Accordingly, the long sheet LS transported may be transferred and transported without being caught in the first upper surface 350 that is a portion of the upper surface 3*a* of the post-processing section 3 from the upper surface 4*a* of the relay section 4, and sagging of the long sheet LS may be alleviated.

Additionally, since the first upper surface 350 and the second upper surface 360 of the post-processing section 3 becomes gently higher from the base end part 350*a* of the first upper surface 350 toward the terminal part 360*b* of the second upper surface 360, it is possible to alleviate return that the long sheet LS placed on the upper surface 3*a* of the post-processing section 3 in a direction opposite to the transport direction.

In addition, in the present exemplary embodiment, as long as the transport region W1 for the long sheet LS in the upper surface 3*a* of the post-processing section 3 becomes higher on the downstream side in the transport direction of the long sheet LS, the transport region W1 may be integrally configured without being divided into the first upper surface 350 and the second upper surface 360.

Additionally, as illustrated in FIG. 4, even in a case where the extended tray TR2*b* of the stacker tray TR2 of the post-processing section 3 is not extended (refer to arrow A in FIG. 4), a configuration in which the transport region W1 for the long sheet LS in the upper surface 3*a* of the post-processing section 3 becomes higher on the downstream side in the transport direction of the long sheet LS may be adopted.

In the present exemplary embodiment, the base end part 360*a*, which is a transport-direction upstream end of the second upper surface 360 that is a transport region for the long sheet LS of the post-processing section 3, is lower than the terminal part 350*b* that is a transport-direction downstream end of the first upper surface 350, and as illustrated in FIG. 6, is openable and closable toward the upstream side in the transport direction of the long sheet LS (refer to an arrow illustrated in FIG. 6).

Specifically, the second upper surface 360 has an opening/closing center 360*c* below the base end part 360*a* (−Z direction), and is adapted to be rotatable without the base end part 360*a* coming into contact with the terminal part 350*b* of the first upper surface 350 during an opening and closing operation.

Accordingly, the catching of the long sheet LS transported may be suppressed as compared to a configuration in which a portion on an upper side of the post-processing section 3 is moved to the upper surface 4*a* side of the relay section 4 in order to expose the interior of the post-processing section 3.

2.3 Both Outsides of Transport Route

Figure 7B:
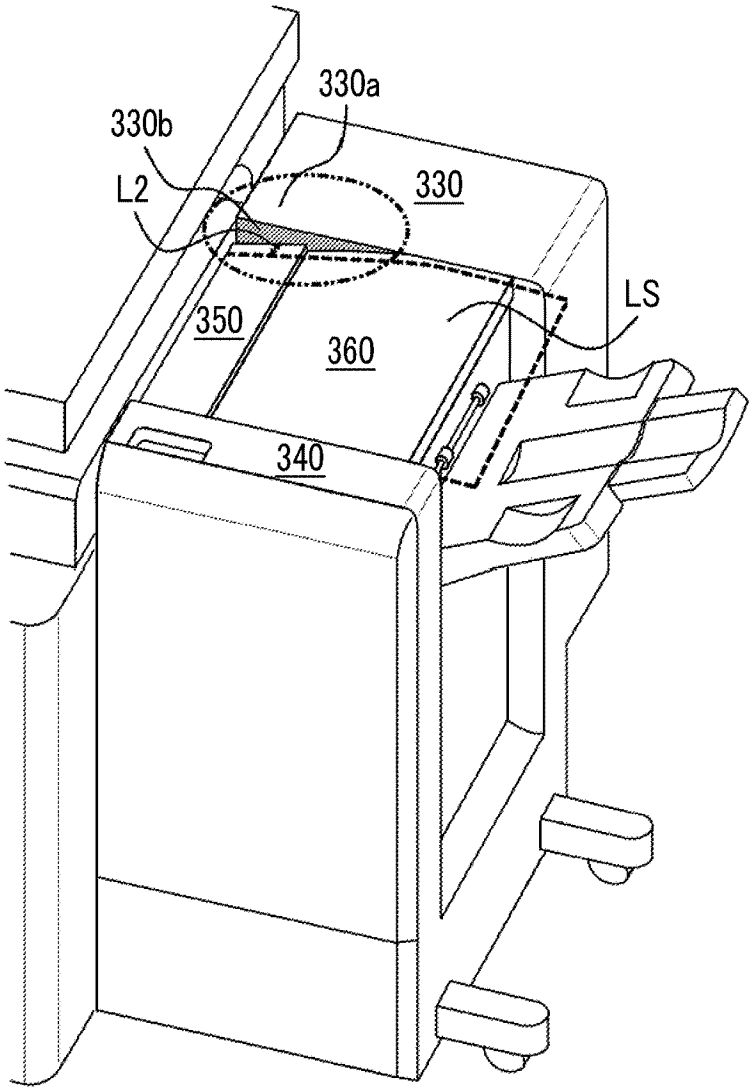
FIG. 7B is a perspective view illustrating the upper surface of the post-processing section with a viewpoint on a near side.
Figure 7A:
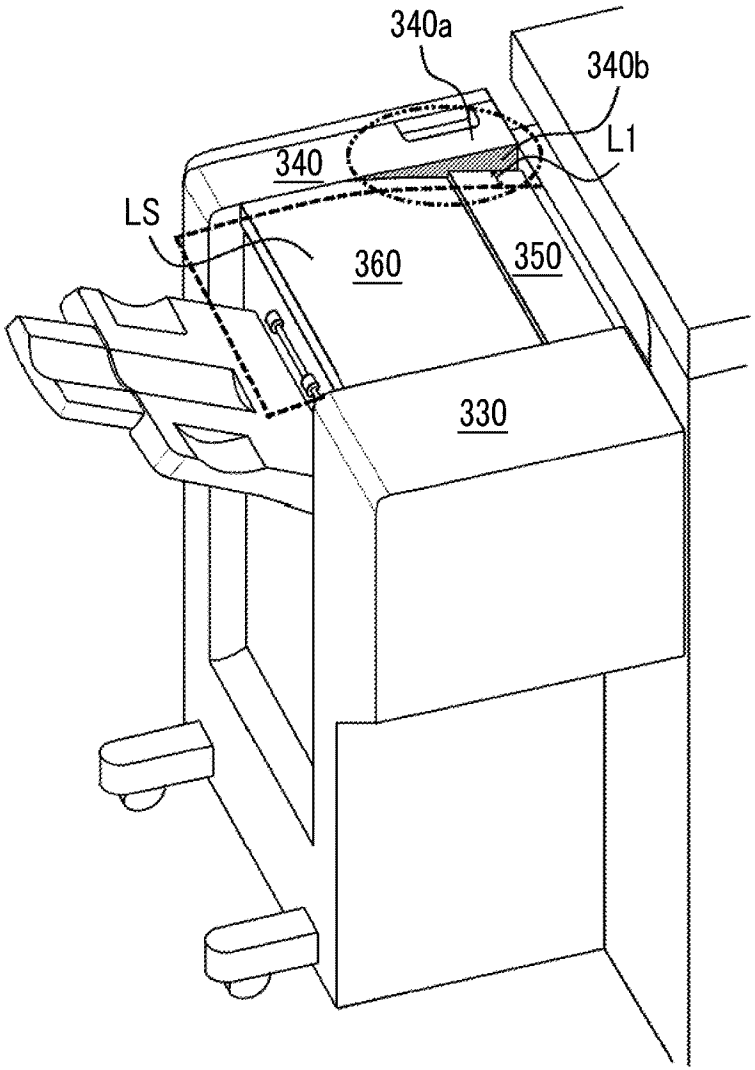
FIG. 7A is a perspective view illustrating the upper surface of the post-processing section with a view point on a far side.
Figure 8:
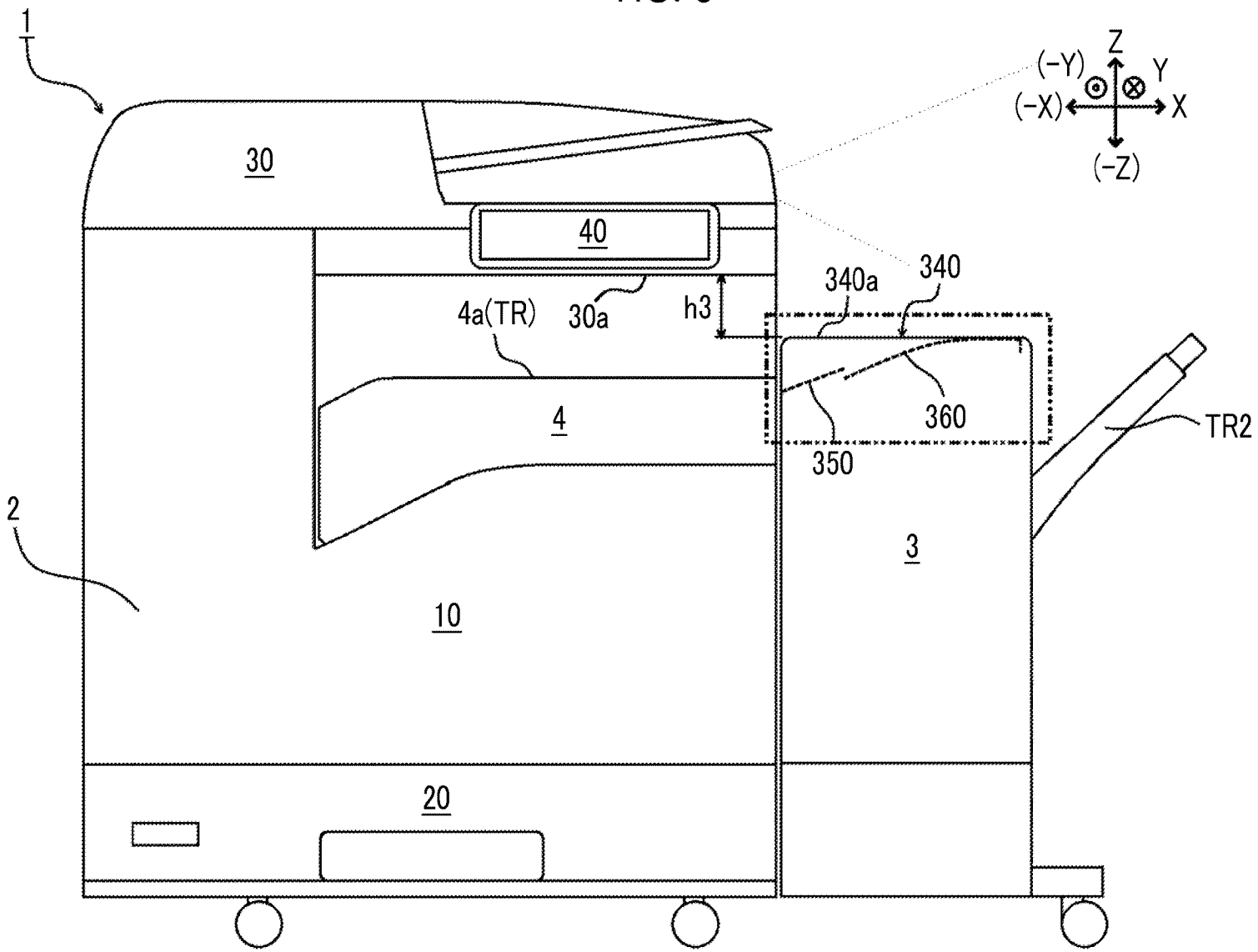
FIG. 8 is a front view illustrating an overall appearance of the image forming apparatus.
Figure 9:
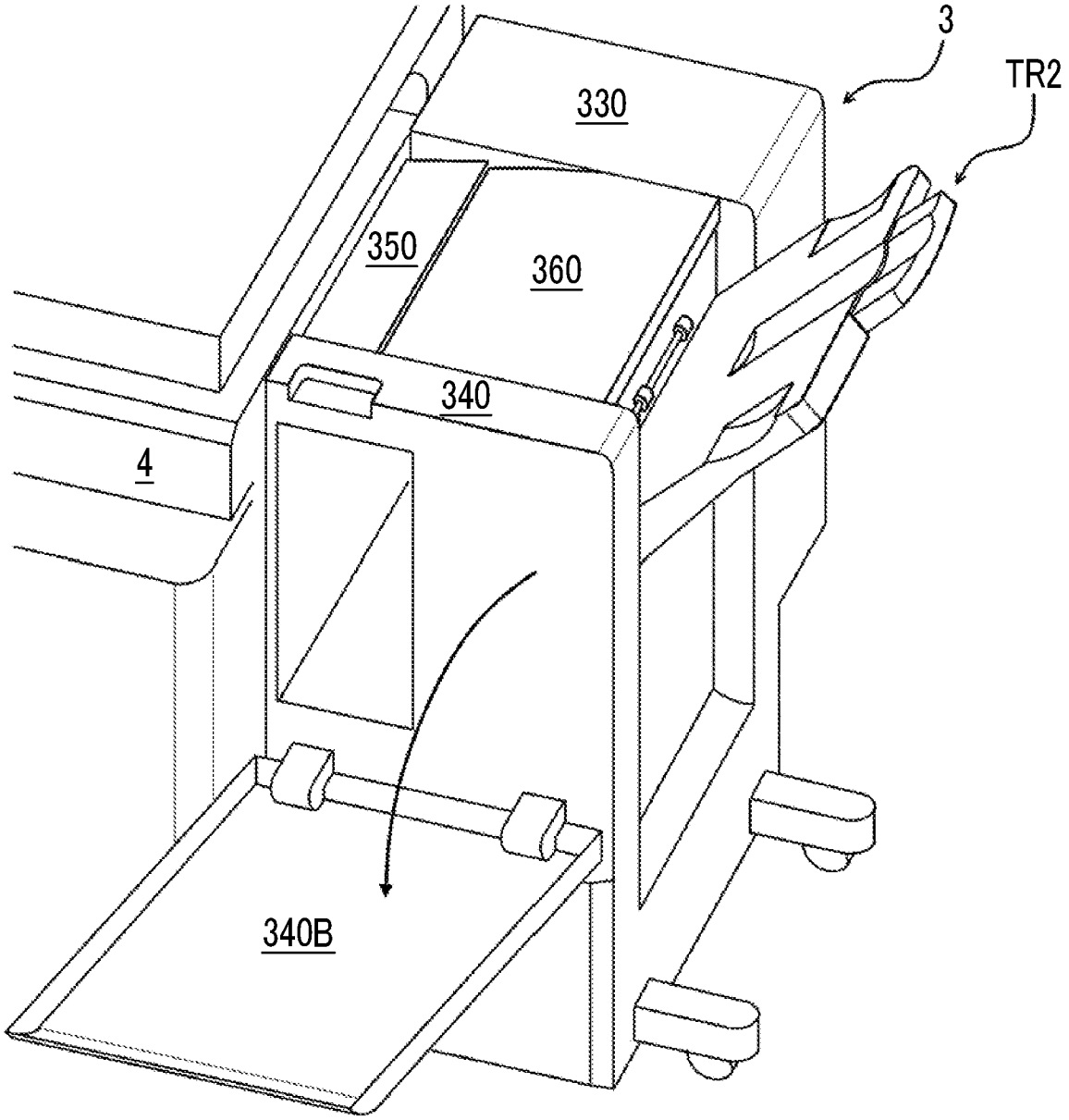
FIG. 9 is a perspective view illustrating opening and closing on the near side of the post-processing section.

FIG. 7A is a perspective view illustrating the upper surface 3*a* of the post-processing section 3 with a view point on the far side, FIG. 7B is a perspective view illustrating the upper surface of the post-processing section with a view point on the near side, FIG. 8 is a front view illustrating an overall appearance of the image forming apparatus 1, and FIG. 9 is a perspective view illustrating the opening and closing on the near side of the post-processing section 3.

As illustrated in FIG. 7A, the near-side upper surface 340 of the post-processing section 3 has a portion 340*a* that is higher than the first upper surface 350 and the second upper surface 360 serving as the transport region for the long sheet LS (refer to a region surrounded by a two-dot chain line in FIG. 7A). A side surface 340*b* (refer to a region illustrated by halftone dots in FIG. 7A) of the higher portion 340*a* is erected at a position apart with a spacing L1 from the transport region (illustrated by a dashed line in FIG. 7A) for the long sheet LS to the near side.

Accordingly, falling of the long sheet LS to the near side of the apparatus body is prevented, and in a case where the long sheet LS is transported to the first upper surface 350 of the post-processing section 3 via the upper surface 4*a* of the relay section 4, an end part of the long sheet LS does not hit the higher portion 340*a*.

As illustrated in FIG. 7B, the far-side upper surface 330 of the post-processing section 3 has a portion 330*a* that becomes higher than the first upper surface 350 and the second upper surface 360 serving as the transport region for the long sheet LS (refer to a region surrounded by a two-dot chain line in FIG. 7B). A side surface 330*b* (refer to a region illustrated by halftone dots in FIG. 7A) of the higher portion 330*a* is erected at a position apart with a spacing L2 from the transport region (illustrated by a dashed line in FIG. 7B) for the long sheet LS to the far side.

Accordingly, in a case where the long sheet LS is transported to the first upper surface 350 of the post-processing section 3 via the upper surface 4*a* of the relay section 4, an end part of the long sheet LS does not hit the higher portion 330*a*.

Additionally, the spacing L1 between the transport region for the long sheet LS and the side surface 340*b* of the higher portion 340*a* on the near side is greater than the spacing L2 between the transport region for the long sheet LS and the side surface 330*b* of the higher portion 330*a* on the far side. Accordingly, in a case where the long sheet placed on the first upper surface 350 and the second upper surface 360 of the post-processing section 3 is taken out from the near side of the apparatus body, the higher portion 340*a* on the near side does not easily become an obstacle.

Additionally, as illustrated in FIGS. 7A and 7B, a width W3 of the transport region for the long sheet LS and the higher portion 340*a* on the near side, the transport region for the long sheet LS and the higher portion 330*a* on the far side is narrower than the transport region in the upper surface 4*a* of the relay section 4 (refer to W0 and W3 in FIGS. 7A and 7B).

Accordingly, the falling of the long sheet in the width direction intersecting the transport direction may be prevented.

As illustrated in FIG. 8, the higher portion 340*a* of the near-side upper surface 340 of the post-processing section 3 has a substantially rectangular shape in a front view from the apparatus body and has a shape without irregularities (refer to a region surrounded by a two-dot chain line in FIG. 8). Accordingly, neat appearance is obtained in a front view from the apparatus body, and design is excellent.

As illustrated in FIG. 9, the post-processing section 3 is formed such that an apparatus body near side thereof is divided into the far side 340A that faces the transport region for the long sheet LS and the near side 340B that does not face the transport region, and the near side 340B is openable and closable. Accordingly, the interior of the post-processing section may be exposed while regulating the width direction intersecting the transport direction of the long sheet LS.

As illustrated in FIG. 8, the near-side upper surface 340 of the post-processing section 3 is configured so as to be higher than the upper surface 4*a* of the relay section 4 and lower than a lower surface 30*a* of the reading device 30 (refer to h3 in FIG. 8). Accordingly, the long sheet LS may be taken out from the near side of the apparatus body.

2.4 Leading Edge Side of Transport Route in Transport Direction

Figure 10:
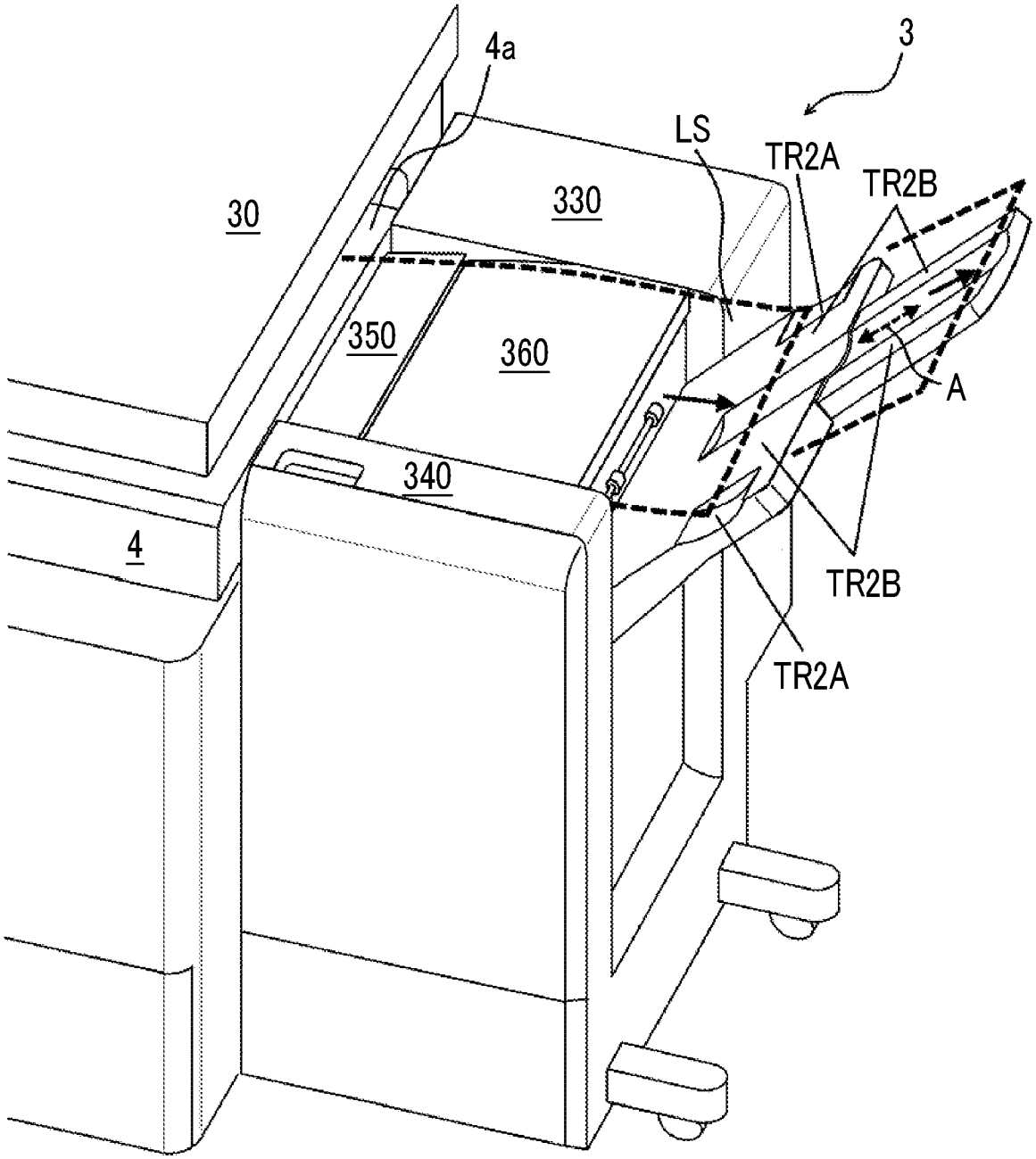
FIG. 10 is a perspective view illustrating an upper surface of a stacker tray.

FIG. 10 is a perspective view illustrating an upper surface of the stacker tray TR2.

A stacker tray TR2 on which the post-processed paper bundle PB is to be stacked is disposed on a right side surface of the post-processing section 3. The stacker tray TR2 includes a stacker tray body TR2*a* that is moved upward and downward (Z direction) (refer to arrow R in FIG. 1) by a lifting device (not illustrated) provided in a body of the post-processing section 3, and the extended tray TR2*b* coupled to the stacker tray body TR2*a*. The extended tray TR2*b* is configured to be capable of being drawn with respect to the stacker tray body TR2*a* (refer to arrow A in FIG. 10).

In the present exemplary embodiment, in a case where the recording material to be transported is the long sheet LS, stacker tray TR2 is located at the highest position to supports the long sheet LS.

As illustrated in FIG. 10, the stacker tray TR2 includes recesses TR2A lower than the terminal part 360*b* of the second upper surface 360 of the post-processing section 3 on both sides in a direction intersecting the transport direction of the recording material, and an upper surface TR2B higher than the terminal part 360*b* of the second upper surface 360 of the post-processing section 3 in the transport region for the long sheet LS. Accordingly, the long sheet LS to be transported may be transferred without being caught in the upper surface of the stacker tray TR2 from the upper surface 3*a* of the post-processing section 3.

Figure 11A:
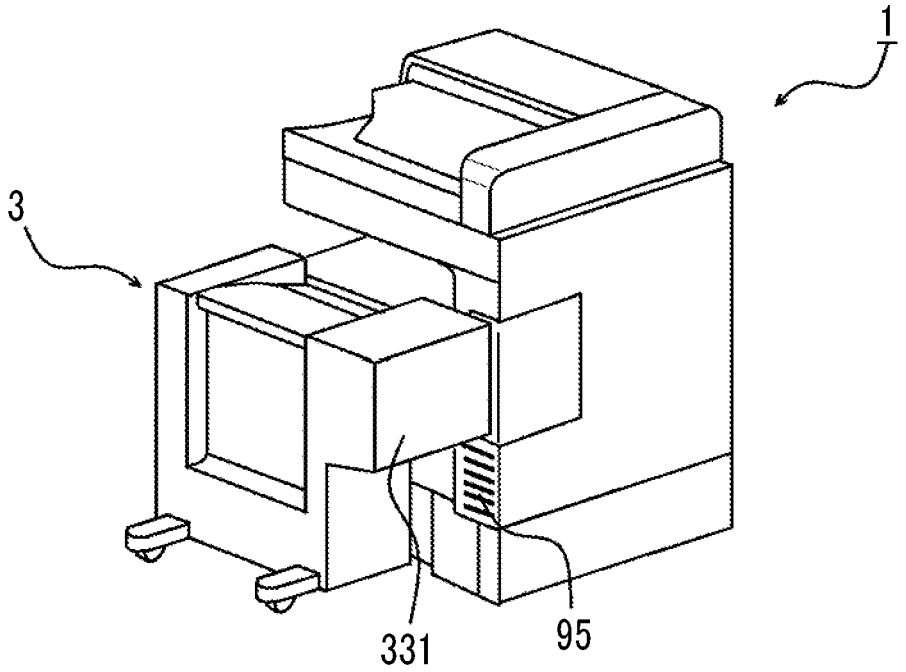
FIG. 11A is a perspective view with a view point on a back surface side of the image forming apparatus.
Figure 11B:
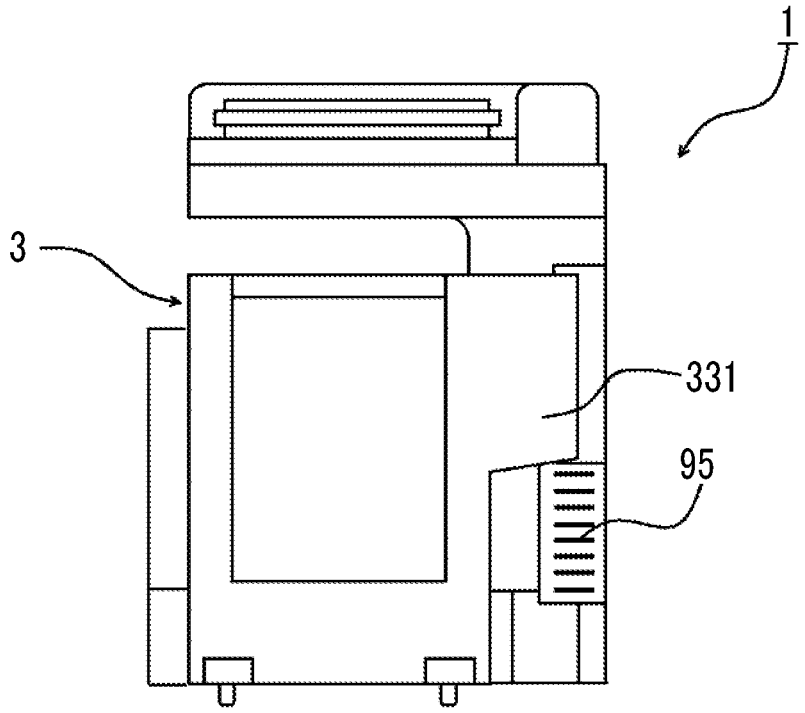
FIG. 11B is a view illustrating a right side surface of the image forming apparatus.

FIG. 11A is a perspective view with a view point on a back surface side of the image forming apparatus 1, and FIG. 11B is a view illustrating a right side surface of the image forming apparatus 1.

As illustrated in FIGS. 11A and 11B (the stacker tray TR2 is not illustrated), an intake port 95 that takes in air from the outside into the apparatus body is provided on the right side surface of the image forming apparatus 1. The post-processing section 3 is disposed on the right side surface of the image forming apparatus 1 so as to receive the paper P ejected from the image forming unit 10 and perform the post-processing.

In the post-processing section 3 according to the present exemplary embodiment, a mechanism (not illustrated) for the post-processing is disposed on the far side of the post-processing section 3 and is covered with a cover member 331 having the far-side upper surface 330. As illustrated in FIG. 11B, the cover member 331 is disposed so as not to block the intake port 95. Accordingly, even in a case where the post-processing section 3 is disposed on the right side surface of the apparatus body, required air may be taken into the apparatus body.

In this way, in the image forming apparatus 1 according to the present exemplary embodiment, in a case where the recording material is the long sheet LS, the recording material is ejected from the second ejection roller pair 64 serving as an upper transport part disposed on the upper side out of the first ejection roller pair 63 and the second ejection roller pair 64 disposed vertically side by side in the apparatus body to the upper surface of the relay section 4.

In the transport region for the long sheet LS, the upper surface of the post-processing section 3 that receives the recording material from the relay section 4 is lower than the upper surface 4*a* of the relay section 4. Thus, the long sheet LS to be transported may be transferred without being caught in the upper surface of the post-processing section 3 from the upper surface 4*a* of the relay section 4.

Additionally, in the transport region for the long sheet LS, the upper surface of the post-processing section 3 is gently inclined so as to becomes higher toward the downstream side in the transport direction. Therefore, the catching of the long sheet LS may be suppressed, and the sagging can be alleviated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an upper ejection roller pair and a lower ejection roller pair that are disposed vertically side by side in an apparatus body and transport a recording material;

a relay section that comprises an ejection tray, an inlet roller pair for receiving the recording material immediately transported from the lower ejection roller pair, and a plurality of transporting rollers disposed under the ejection tray in a horizontal manner, wherein the relay section is disposed at an upper part of the apparatus body, further transports the recording material transported from the lower ejection roller pair and supports the recording material transported from the upper ejection roller pair on an upper surface of the relay section that serves as the ejection tray;

a post-processing section that at least comprises a reception roller for receiving the recording material from the relay section and a compile tray disposed on a downstream side of the reception roller, wherein the post-processing section is disposed on a side of the apparatus body, receives the recording material via the relay section, and performs post-processing; and a controller that performs a control such that the recording material is transported from the upper ejection roller pair to the upper surface of the relay section in a case where the recording material is a long sheet, wherein the post-processing section further includes a stacking tray that stacks the recording material, the stacking tray includes a stacking tray body that moves upward and downward in a direction intersecting a transport direction of the recording material and an extended tray that is coupled to the stacking tray body and capable of being pulled out from the stacking tray body in a direction away from the compile tray, wherein the post-processing section becomes higher on a downstream side in a transport direction of the long sheet, in a transport region for the long sheet in a width direction intersecting the transport direction in which the recording material is transported, wherein an upper surface of the post-processing section is made up of a first upper surface and a second upper surface continuous with the first upper surface, in the transport direction, wherein the first upper surface is gently inclined from an upstream side toward a downstream side of the upper surface of the post-processing section such that a transport-direction upstream end of the first upper surface is lower than the entire upper surface of the relay section and a transport-direction downstream end of the first upper surface is higher than the entire upper surface of the relay section, and wherein a transport-direction upstream end of the second upper surface is lower than the transport-direction downstream end of the first upper surface and is a pivot point such that the second upper surface is openable and closable.

2. The image forming apparatus according to claim 1, wherein the upper surface of the post-processing section is lower than the upper surface of the relay section, in the transport region for the long sheet in a width direction intersecting the transport direction in which the recording material is transported and in a region where the relay section and the post-processing section are adjacent to each other in the transport direction.

3. The image forming apparatus according to claim 1, wherein a portion of the post-processing section higher on the downstream side is gently inclined so as to be higher toward the downstream side.

4. The image forming apparatus according to claim 1, wherein the upper surface of the post-processing section has a step, and at a position of the step, a base end part of the upper surface on a downstream side of the position of the step is lower than a terminal part of the upper surface on an upstream side of the position of the step.

5. The image forming apparatus according to claim 1, wherein, in a region outside the transport region in a width direction intersecting the transport direction of the long sheet, the upper surface of the post-processing section has a portion that is higher than the transport region.

6. The image forming apparatus according to claim 5, wherein a width of the portion that is higher than the transport region is narrower than the transport region.

7. The image forming apparatus according to claim 5, wherein a portion of the post-processing section is formed such that a back side thereof faces the transport region and a front side thereof does not face the transport region, and is openable and closable on the front side.

8. The image forming apparatus according to claim 7, further comprising:

a reading unit that is disposed above the relay section, wherein the upper surface of the post-processing section on the near side of the apparatus body is higher than the upper surface of the relay section and lower than a lower surface of the reading unit.

9. The image forming apparatus according to claim 1, wherein in a case where the recording material is the long sheet, the stacking tray is located at a highest position and supports the long sheet.

10. The image forming apparatus according to claim 9, wherein the stacking tray includes both sides in the direction intersecting the transport direction of the recording material having recesses, which are lower than a transport-direction downstream end of the upper surface of the post-processing section, and an upper surface of the stacking tray in the transport region for the long sheet is higher than the transport-direction downstream end of the upper surface of the post-processing section.

11. The image forming apparatus according to claim 1, wherein the post-processing section is disposed on the side surface of the apparatus body so as not to block an intake port that is provided in the side surface of the apparatus body and takes in air from the outside.

* * * * *